US012276070B2

(12) United States Patent
Bustamante et al.

(10) Patent No.: US 12,276,070 B2
(45) Date of Patent: Apr. 15, 2025

(54) MECHANISM FOR RECIPROCAL MOVEMENT OF STACKS OF SLEEPERS, AND RAILWAY VEHICLE COMPRISING SUCH A MECHANISM

(71) Applicant: MATISA MATERIEL INDUSTRIEL S.A., Crissier (CH)

(72) Inventors: Jorge Bustamante, Crissier (CH); Jacques Pilet, Crissier (CH)

(73) Assignee: MATISA MATERIEL INDUSTRIEL S.A., Crissier (CH)

( * ) Notice: Subject to any disclaimer, the term of this patent is extended or adjusted under 35 U.S.C. 154(b) by 927 days.

(21) Appl. No.: 17/227,041

(22) Filed: Apr. 9, 2021

(65) Prior Publication Data

US 2021/0348341 A1 Nov. 11, 2021

(30) Foreign Application Priority Data

Apr. 11, 2020 (FR) ..... 2003671

(51) Int. Cl.
*E01B 31/20* (2006.01)
*B61D 15/00* (2006.01)
(Continued)

(52) U.S. Cl.
CPC ..... *E01B 31/20* (2013.01); *B61D 15/00* (2013.01); *E01B 27/12* (2013.01); *E01B 27/13* (2013.01);
(Continued)

(58) Field of Classification Search
CPC ..... E01B 31/20; E01B 29/06; E01B 29/10; E01B 29/13; E01B 2203/141; E01B 27/12; E01B 27/13; E01B 27/20; B61D 15/00
(Continued)

(56) References Cited

U.S. PATENT DOCUMENTS 3,752,332 A * 8/1973 Theurer ..... B65D 19/12 108/56.1
4,152,990 A * 5/1979 Theurer ..... E01B 29/06 414/626
(Continued)

FOREIGN PATENT DOCUMENTS

DE 10205948 A1 * 8/2003 ..... B61D 3/20
EP 1063354 A1 * 12/2000 ..... E01B 29/10
(Continued)

OTHER PUBLICATIONS

FR2003671, Aug. 27, 1976, French Search Report.
European Search Report received for EP 21167759, mailed Jul. 1, 2021, 2 pages.

*Primary Examiner* — S. Joseph Morano
*Assistant Examiner* — James William Jones
(74) *Attorney, Agent, or Firm* — RAY QUINNEY & NEBEKER P.C.; Paul N. Taylor

(57) ABSTRACT

The invention relates to a mechanism (130) for moving stacks (21', 22') of sleepers (21, 22) intended to equip a railway track, the displacement mechanism (130) being intended to equip at least two successive work wagons (100, 200, 300) of a railway vehicle (1), the displacement mechanism (130) comprising guide means (140) configured to guide, along a longitudinal direction (X) of each of the wagons, a plurality of adjacent carriages (131) in pairs, the displacement mechanism (130) comprising drive means (150) for moving the carriages (131) together reciprocally between a first and a second travel position, so that each carriage (131) carries a stack (21', 22') of sleepers (21, 22) following a forward path (W1) from the first to the second
(Continued)

travel position and configured to travel a return path (W2) from the second to the first travel position while being unloaded.

16 Claims, 5 Drawing Sheets

(51) Int. Cl.

| | |
|---|---|
| ***E01B 27/12*** | (2006.01) |
| ***E01B 27/13*** | (2006.01) |
| ***E01B 27/20*** | (2006.01) |
| ***E01B 29/06*** | (2006.01) |
| ***E01B 29/10*** | (2006.01) |
| ***E01B 29/13*** | (2006.01) |

(52) U.S. Cl.
CPC ..... *E01B 27/20* (2013.01); *E01B 29/06* (2013.01); *E01B 29/10* (2013.01); *E01B 29/13* (2013.01); *E01B 2203/141* (2013.01)

(58) Field of Classification Search
USPC ..... 104/4
See application file for complete search history.

(56) References Cited

U.S. PATENT DOCUMENTS

| | | | | | |
|---|---|---|---|---|---|
| 4,253,398 | A * | 3/1981 | Theurer | E01B 29/05 | 104/2 |
| 4,275,659 | A * | 6/1981 | Theurer | E01B 27/06 | 104/2 |
| 2007/0034109 | A1* | 2/2007 | Albert | B62D 47/025 | 105/329.1 |
| 2020/0385934 | A1* | 12/2020 | Salciccia | B65G 37/005 | |
| 2021/0179150 | A1* | 6/2021 | Lintz | B65G 67/10 | |

FOREIGN PATENT DOCUMENTS

| | | | | |
|---|---|---|---|---|
| EP | 3748081 | A1 | 12/2020 | |
| FR | 2097373 | | 3/1972 | |
| FR | 2299459 | | 8/1976 | |
| FR | 2299459 | A1 * | 8/1976 | |
| FR | 2728285 | A1 * | 6/1996 | E01B 29/06 |
| FR | 2760473 | A1 * | 9/1998 | E01B 29/06 |
| FR | 2931777 | A1 * | 12/2009 | B61D 3/187 |
| GB | 2029874 | A | 3/1980 | |
| WO | 2019129678 | A1 | 7/2019 | |
| WO | WO2019129678 | | 7/2019 | |

* cited by examiner

MECHANISM FOR RECIPROCAL MOVEMENT OF STACKS OF SLEEPERS, AND RAILWAY VEHICLE COMPRISING SUCH A MECHANISM

TECHNICAL FIELD OF THE INVENTION

The invention relates, in general, to the technical field of construction and renewal trains involving the placement of the equipment required for the construction of railways or, in the case of renewal, the replacement of all or part of the constituent materials of the tracks, namely the rails and sleepers, as well as the ballast, which ensures the stability of the track on its platform, when these materials are degraded.

The invention relates more specifically to a mechanism for moving stacks of sleepers intended to equip a plurality of successive wagons of a railway vehicle and enable them to be moved along said wagons.

PRIOR ART

Builders or operators of rail transport networks regularly need to build new rail lines or rebuild existing rail lines, i.e., to replace some of the elements that compose them, such as rails and the sleepers supporting the rails, as well as the fastening means and other accessories. Much of this need for renewal is due to age and wear of the tracks, but it can also involve replacing older models with newer models in order to make better performance possible.

In the most complete case of renewal or construction, such operations are carried out using a rail convoy such as a so-called renewal or replacement train, or construction train, comprising multiple specialized machines for carrying out the various substitution or construction operations. A typical renewal operation involves the use of specialized rail convoys comprising machines that are capable of carrying out the following operations in sequence: clearing, sorting of the ballast, and removal of the cleared products by conveyor belts on wagons used for unloading or by direct jet to the backfill, replacement of the renewed track (rails and sleepers), ballasting and lifting of the track, leveling and straightening, welding of the rails, relieving of stresses, renewed leveling/straightening, adjustment of the benches, and cleaning of the shoulders.

Whether for construction or renewal, such a rail convoy comprises a plurality of wagons for transporting sleepers, which are at least new and, where appropriate, old, in order to supply specialized machines such as equipment for laying new sleepers and/or to remove worn sleepers from removal equipment.

It is known to equip such a set of wagons with a continuous roller track for a gantry which, in moving reciprocally, removes new sleepers from a first storage wagon, places them on a second wagon, particularly on a conveyor belt to the laying equipment, and as necessary takes back worn sleepers that have accumulated on a third wagon, possibly corresponding to the second wagon, and deposits them on a fourth storage wagon, which may possibly correspond to the first wagon. The use of such a gantry makes it difficult to implement two conveying flows, especially when these directions of circulation are opposed in terms of the supplying of new sleepers to the laying equipment and the removal of worn sleepers from laying equipment to storage wagons. In addition, the back-and-forth movements of the gantry on its running track at relatively high speed alongside a plurality of wagons require special precautions and attention to avoid possible accidents involving people in the vicinity of the train or on the train during the laying and removal of new and worn sleepers.

A wagon is also known from document WO2019129678A1 for transferring pallets between an upper conveyor located on an upper floor of the wagon and a lower conveyor located on a lower floor of the wagon, the two conveyors being superposed and having opposite directions of movement. The transfer is carried out by an elevator that moves in purely vertical fashion between an upper receiving zone located at the outlet of the upper conveyor and a conveying platform located at the entrance of the lower conveyor, directly below the upper conveyor. Such a device is particularly complex due to its having to manage two movement flows of superposed stacks of sleepers, resulting in a relatively high center of gravity that has an impact on the stability of the various work wagons concerned. In addition, the passing of the stacks of sleepers along the various wagons is particularly restrictive and requires perfect stability, especially when the train moves on curved paths.

DISCLOSURE OF THE INVENTION

The invention aims to remedy all or part of the drawbacks of the prior art, particularly by proposing a solution that makes it possible to provide for the movement of the sleepers while overcoming the drawbacks associated with the movement of this gantry along its path, all while ensuring good stability of the wagons and easy movement of the sleepers in curves.

According to a first aspect of the invention, a mechanism for moving stacks of sleepers intended to equip a railway track is proposed for this purpose, the displacement mechanism being intended to equip a group of at least two successive work wagons of a railway vehicle, each work wagon comprising a frame supported by at least one wheelset, the displacement mechanism comprising guide means configured to guide, along a longitudinal direction of each of the work wagons, a plurality of adjacent carriages in pairs, the displacement mechanism comprising drive means for jointly moving the carriages reciprocally between a first and a second travel position so that each carriage carries a stack of sleepers following a forward path from the first to the second travel position, so that, for a given pair of adjacent carriages among the plurality of carriages comprising a front carriage and a rear carriage, the second travel position of the rear carriage corresponds to the first travel position of the front carriage and is configured to travel a return path from the second to the first travel position while being unloaded.

By virtue of such a combination of features, the carriages can themselves move reciprocally along the same path and over a relatively short stroke without the need to move a gantry, making it possible to guarantee the safety of people located in the vicinity of the wagon.

According to one embodiment, at least some of the adjacent carriages in pairs are interconnected by at least one articulation to form a transport structure, so that each transport structure preferably comprises three successive carriages. Such a structure of a plurality of interconnected carriages enables the movement of the stacks between two wagons to be facilitated. This makes it possible to facilitate the direct driving of a trolley and the indirect driving of the trolleys to which it is connected. This avoids the use of complex drive means for enabling passage from one wagon to another.

According to one embodiment, the carriages of the same transport structure are connected in pairs by a connecting rod, the connecting rod comprising two opposite ends spaced apart longitudinally, each of which is preferably connected to one or the other of the two carriages by a ball joint. The use of such a connection makes it possible to facilitate the relative rotation between the carriages that occurs particularly during passage between two wagons when the railway vehicle is on curved paths. A certain predetermined distance is thus maintained between the carriages as a function of the length of the connecting rod, making it possible to avoid possible impacts between the stacks of sleepers being carried by adjacent carriages when on these paths. The stability of the stacks of sleepers being carried while on these trajectories is also improved.

According to one embodiment, the displacement mechanism is configured to move each carriage reciprocally by an interval corresponding to a distance between the first travel position and the second travel position, which is greater than or equal to a length of a stack of sleepers. This step is chosen so as to be sufficiently large to cover a distance separating two adjacent wagons.

According to one embodiment, the guide means comprise guide shoulders that are located laterally on either side of each carriage so as to laterally delimit and flank the forward and return paths. Such a structure provides guidance that is easy to implement and sufficiently precise in the context of such use.

According to one embodiment, each carriage defines a first support plane, the displacement mechanism comprising a supporting structure that defines a second support plane, the displacement mechanism further comprising an elevator mechanism that is configured to vary the relative vertical position of the first and second support planes relative to one another when the carriages are in their first and second longitudinal travel position, so that each stack of sleepers rests on the vertically highest support plane among the first and second support planes. Such a structure makes sequenced and stable movement of the stacks of sleepers possible. In the case of stacks of sleepers, the average speed of movement of the stacks generally depends on the time when the stacks of sleepers are unstacked at the end of the forward path of the stacks, following the forward paths of each of the carriages.

According to one embodiment, the supporting structure forms, or consists of, the guide shoulders. This configuration allows the use of a single structure to perform two functions, namely to guide the carriages along the forward and return paths on the one hand and to take up the load of the carriage stacks according to the relative position of the first and second support planes on the other hand.

According to one embodiment, the supporting structure is secured to the frame by the lifting mechanism, said lifting mechanism comprising jacks such as hydraulic jacks. The use of hydraulic jacks makes it possible to use a source of hydraulic energy commonly used on this type of railway vehicle and can be easily connected to such a hydraulic circuit.

According to one embodiment, the drive means comprise at least one chain that engages with a drive wheel that is integral with all or part of the carriages in order to drive each carriage reciprocally, the chain preferably driving a carriage directly by transport structure.

According to another aspect of the invention, it relates to a railway work vehicle of the type comprising, for example, equipment for laying new sleepers and/or removing worn sleepers, the railway vehicle comprising at least two successive work wagons, the railway work vehicle being remarkable in that it comprises at least one mechanism for moving stacks of sleepers as described above.

According to one embodiment, at least some of the work wagons comprise an upper conveyor device located at a height greater than that of the displacement mechanism, the conveyor device being configured to transport sleepers individually. Such a configuration thus enables conveyance of stacks of sleepers at a lower level by means of the displacement mechanism on the one hand, and conveyance of individual sleepers at a higher level, and hence above the displacement mechanism, on the other hand. In such a configuration, a relatively low center of gravity is achieved, which improves the stability of the rail convoy.

According to one embodiment, the displacement mechanism enables sleepers to be moved in stacks of superposed sleepers in a first direction of movement along a longitudinal direction of each given work wagon, and the upper conveyor device enables sleepers to be moved individually, in a second direction of travel opposite the first direction, along the longitudinal direction of each given work wagon.

BRIEF DESCRIPTION OF THE FIGURES

Other features and advantages of the invention will become apparent from the description that follows with reference to the appended figures, in which.

For greater clarity, identical or similar elements are identified by identical reference signs in all of the figures.

In the description and the claims, in order to clarify the description and the claims, the longitudinal, transverse, and vertical terminology will be adopted without limitation with reference to the trihedron X, Y, Z indicated in the figures.

DETAILED DESCRIPTION OF AN EMBODIMENT

Figure 1:
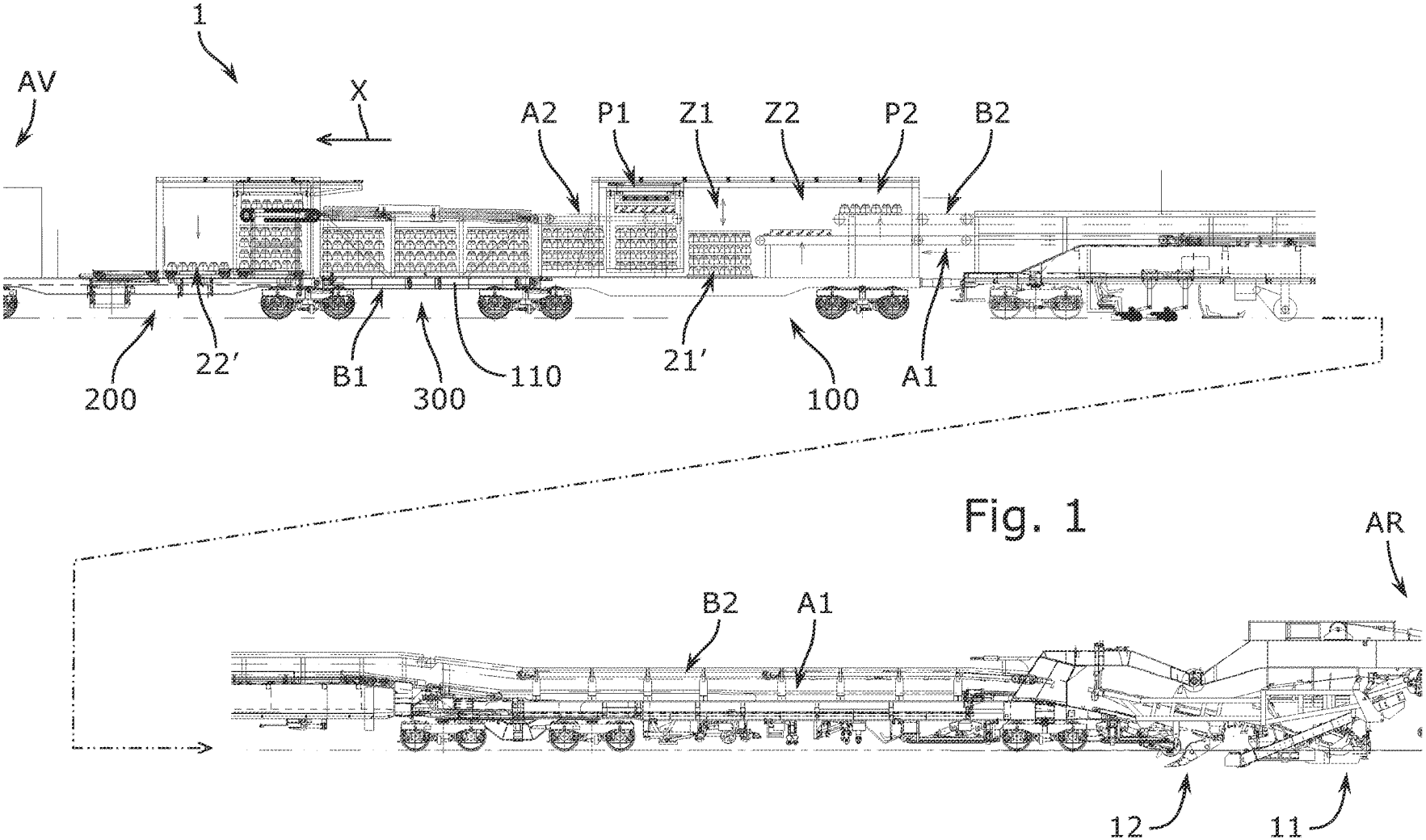
FIG. 1 is a side view of a railway vehicle according to one embodiment of the invention.
Figure 2:
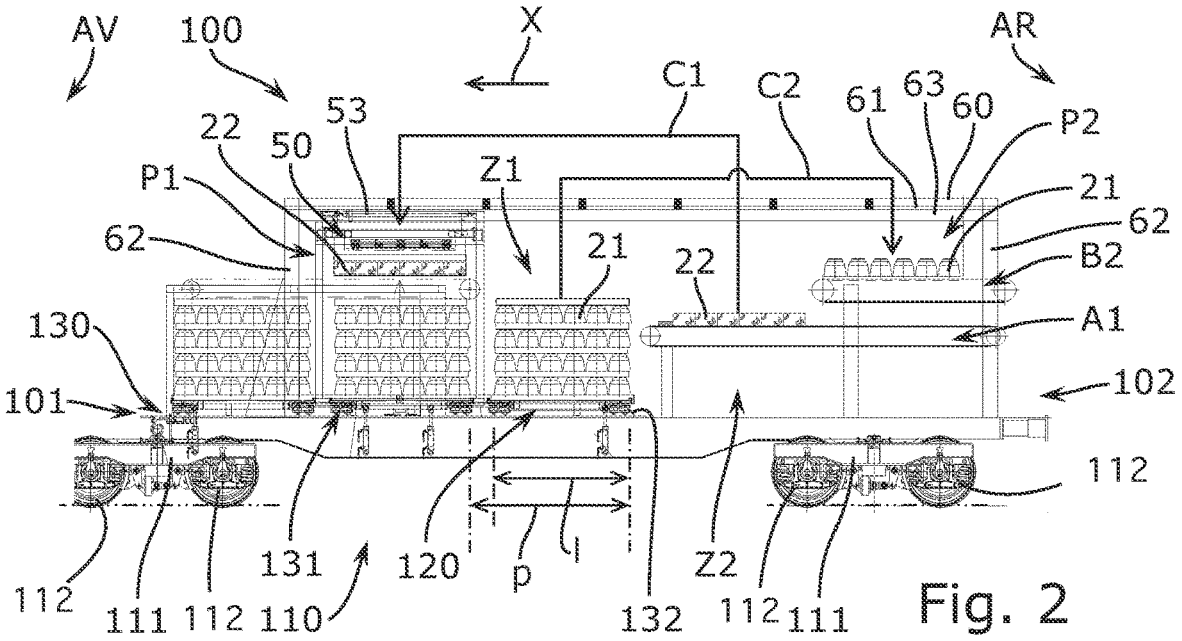
FIG. 2 is a side view of a transfer wagon according to this embodiment of the invention.
Figure 3:
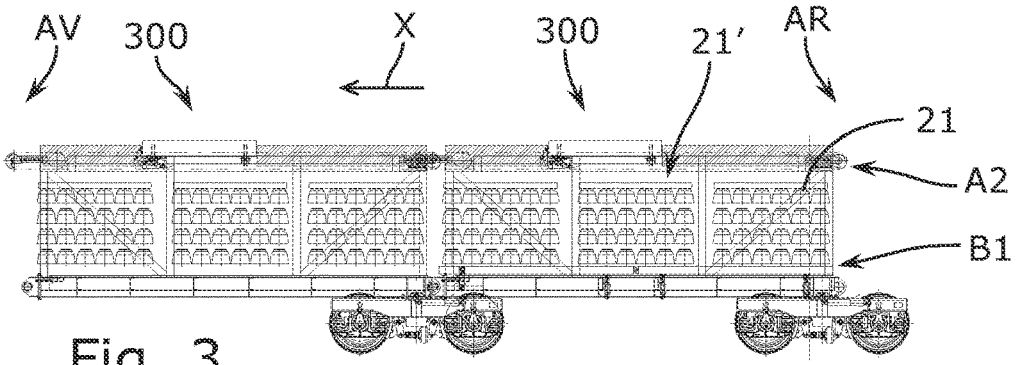
FIG. 3 is a side view of a storage wagon according to this embodiment of the invention.

With reference to FIG. 1, a railway vehicle 1 is illustrated of the type comprising equipment 11 for laying new sleepers 21 and removing 12 worn sleepers 22. The main function of this sleeper laying and removal equipment 21, 22 is to repair railway tracks, for example to replace worn sleepers 22 or to replace them with more recent models and thus improve the performance of the tracks.

The railway vehicle 1, for example a renewal train as illustrated in FIG. 1, is formed by a succession of wagons that are linked together, generally in an articulated manner, forming a rail convoy and towed by a locomotive. During work, the renewal train 1 moves in a forward direction, and each wagon extends in a longitudinal direction X and has a front end AV that is oriented in the direction of travel of the train and an opposite rear end AR that is longitudinally opposed to the front end AV.

With reference to FIGS. 1 to 10, the renewal train 1 is equipped with a wagon 100 for transferring sleepers 21, 22. The transfer wagon 100 is intended to be placed relative to the renewal train 1, between at least one wagon comprising equipment for laying 11 new sleepers 21 and for removing 12 worn sleepers 22 on the one hand and wagons 300 (FIG. 3) for storing new sleepers 21 and worn sleepers 22 on the other hand. The function of the transfer wagon 100 is to ensure the continuity of flow between:

- a flow C1 for the removal of worn sleepers 22 from the equipment for removing worn sleepers 22 to a storage area of the railway vehicle 1, which can extend over a plurality of storage wagons, the removal flow C1 being oriented along the longitudinal direction of the transfer wagon and in a first direction; and
- a flow C2 for supplying new sleepers 21 from a storage area of the train to the equipment for laying the new sleepers 21, the supply flow C2 being oriented along the longitudinal direction of the transfer wagon and in a second direction opposite the first direction.

In the configuration illustrated in the figures, the equipment 11 for laying new sleepers 21 and the equipment 12 for removing worn sleepers 22 are located at the rear of the railway vehicle 1 relative to the wagon 100 for transferring sleepers 21, 22, and the storage wagons 300 are located at the front of the railway vehicle 1 relative to the wagon 100 for transferring sleepers 21, 22. The opposite arrangement is possible, however.

The transfer wagon 100, like the other wagons of the railway vehicle 1, comprises a frame 110 supported by two bogies 111 that are located at the two front and rear ends of the frame 110 and each provided with one or more wheelsets 112. For this purpose, provision is preferably made for the bogies to each comprise a bogie frame, at least two wheelsets 112, and at least one suspension between the two wheelsets and the bogie frame. The transfer wagon 100 is located between the flows C1 and C2, i.e., at the intersection of the two flows, one flow C1 for removal of worn sleepers 22 on the one hand, and one flow C2 for supplying new sleepers 21 on the other hand. The 100 transfer wagon comprises:

- a first zone Z1 for receiving and unstacking the new sleepers 21 that is configured to receive the new sleepers 21 coming from a storage zone 300 of the railway vehicle 1;
- a first platform P1 for conveying the worn sleepers 22, from which said worn sleepers 22 can be conveyed to a storage area 300 of the railway vehicle 1;
- a second zone Z2 for receiving the worn sleepers 22 that is configured to receive the worn sleepers 22 from the equipment for removing the worn sleepers 22;
- a second platform P2 for conveying the new sleepers 21 from which said new sleepers 21 can be conveyed to the equipment for laying the new sleepers 21.

The transfer wagon 100 comprises at least one transfer conveyor 50 supported by a frame 60, the frame 60 being supported by the frame 110 and secured relative to the frame 110. The transfer conveyor 50 is responsible for transferring new sleepers from the first receiving zone Z1 to and up to the second conveying platform P2, as well as for transferring worn sleepers from the second receiving zone Z2 to and up to the first conveying platform P1. The term "transferring" refers here to the transport, by lifting and moving in the air, of a load constituted here by one or more sleepers from one point to another, here from the receiving zone to the conveying platform. The first and second conveying platforms P1, P2 are each distant from the first and second receiving zones Z1, Z2, along a longitudinal direction X of the transfer wagon 100. Relative to the longitudinal direction X of the transfer wagon 100, the transfer conveyor 50 is located between the receiving zone Z1, Z2 and the conveying platform P1, P2. The implementation of the transfer conveyor 50 thus makes it possible to ensure the continuity of the removal flow C1 of worn sleepers 22 and the supply flow C2 of new sleepers 21.

The path of the worn sleepers 22 is as follows: The equipment 12 for removing worn sleepers 22 extracts worn sleepers 22 one by one and repeatedly and successively and then places them on a first removing conveyor device A1; these worn sleepers 22 are then conveyed by the first removing conveyor device A1 to the second zone Z2 for receiving the worn sleepers 22, where they are handled by the transfer conveyor 50, which moves them to the first platform P1 for conveying worn sleepers 22, from which said worn sleepers 22 are conveyed to a storage area of the railway vehicle 1 by a second removing conveyor device A2.

Here, the first and second removing conveyor devices A1, A2 are conveyor devices with chain(s) 70, preferably metallic, mounted on support and drive devices 71 comprising return wheels, such as cogwheels and idle wheels. Often, these devices also comprise tensioning members (not shown) for the purpose of tightening the chain(s) 70. Preferably, each of the first and second removing conveyor devices A1, A2 comprises at least two chain drive tracks mounted in parallel, the worn sleepers 22 then being conveyed while resting on the two parallel chains at the same time. A chain drive path can be formed by one and the same chain continuously circulating in a closed loop, or by a succession of continuous chains circulating in closed loops arranged successively along this drive path for sleepers. When a plurality of chains or chain drive tracks are mounted in parallel and convey the same sleepers, all or some of the support and drive devices, such as the return wheels and idle wheels, can be optionally shared. As will be readily understood, variants of conveyor devices can be used.

The second zone Z2 for receiving the worn sleepers 22 receiving the worn sleepers 22 from the equipment for depositing 12 the worn sleepers 22 as well as the first platform P1 for conveying the worn sleepers 22, from which said worn sleepers 22 are conveyed to a storage area of the railway vehicle 1, each comprise or are each constituted by one of the respective ends of the first and second removing conveyor devices A1, A2. As a variant, or even in addition, the second zone Z2 for receiving the worn sleepers 22 may comprise a buffer zone that is located in the extension of the first removing conveyor device A1 and makes it possible to temporarily store a plurality of worn sleepers 22 before being taken on together as a bundle. Such a buffer zone comprises an area, for example, that is devoid of any drive means or an area that comprises one or more free or disengaged chains, i.e., without drive means engaged with the chains capable of constraining the rotation of the chains over this portion, which is referred to as the conveyance buffer. In such a configuration, each worn sleeper 22 then completes its journey on the chains of the removing conveyor device and then comes into contact with and bears against the worn sleeper 22 situated in front of it and pushes it while driving it in its movement.

In parallel with the removal flow C1 of the worn sleepers 22, the path of the new sleepers 21 feeding the supply flow C2 of new sleepers 21 is as follows: the new sleepers 21 are conveyed in stacks from a storage area of the railway vehicle 1 to the first zone Z1 for receiving and unstacking the new sleepers 21 by a first forwarding conveyor device B1, where they are supported by the transfer conveyor 50, which moves the new sleepers 21 to the second platform P2 of the new sleepers conveyor 21, from which said new sleepers 21 are conveyed to the laying equipment 11 for the new sleepers 21 by a second forwarding conveyor device B2. The transfer conveyor 50 that performs these operations is the same as that carrying out the operations of transferring the removal flow C1 of the worn sleepers 22. One and the same transfer conveyor 50 thus implements the flows C1 and C2.

The second conveying platform P2 comprises, or even consists of, one of the ends of the second forwarding conveyor device B2. This second forwarding conveyor device B2 can be a chain conveyor 70 as described with reference to the removing conveyor devices A1, A2.

The first forwarding conveyor device B1 comprises, or consists of, a mechanism 130 for moving stacks 21' of new sleepers 21 in order to displace said stacks 21' of sleepers in translation step by step toward and up to the first zone Z1 for receiving and unstacking new sleepers 21.

The displacement mechanism 130 equips a plurality of successive wagons of the railway vehicle 1, including at least some storage wagons 300 and the transfer wagon 100. The set of wagons along which the displacement mechanism extends will hereinafter be called the working wagon. The displacement mechanism 130 comprises two successive carriages 131 that are adjacent in pairs, each carriage 131 being configured to support each stack 21' of new sleepers 21. Each carriage 131 is formed here by a frame—metallic, for example—that is reinforced by a central, preferably metallic longitudinal beam 136. This longitudinal central metal beam 136 of the carriage has at its two opposite ends an interface for receiving one end 134' of a connecting rod 134 with another carriage 131.

The displacement mechanism 130 comprises drive means 150 for moving each of the carriages 131 together reciprocally between a first and a second travel position. Each carriage 131 carries a stack 21', 22' of sleepers 21, 22 following a forward path W1 from the first to the second travel position, such as for a given pair of adjacent carriages 131 among the plurality of carriages 131 comprising a front carriage and a rear carriage, the second travel position of the rear carriage corresponding to the first travel position of the front carriage. The carriages are also configured to travel a return path W2 from the second to the first travel position while being unloaded. The back-and-forth movement of a given carriage 131 is therefore a reciprocating movement along the same path, in a forward direction W1 carrying a stack 21', 22' of sleepers 21, 22, and in a return direction W2 opposite the forward direction and unloaded, meaning that they are not carrying a stack 21', 22' of sleepers 21, 22. Each carriage 131 therefore moves like a shuttle between its two first and second positions.

Guide means 140 are provided to guide the carriages 131 along the longitudinal direction X of each of the work wagons, each having rollers 135 allowing the carriages 131 to run on a guide track 132. The guide means 140 comprise guide shoulders 141 that are located laterally on either side of each carriage 131 so as to laterally delimit and flank the forward and return paths W1, W2.

Some of the adjacent carriages 131 in pairs are interconnected by at least one articulation 133 to form a transport structure 13. Here, each transport structure 13 comprises three successive carriages 131 (for example, see FIGS. 7 and 8). This makes it easy to manage the transfer of a stack 21' of new sleepers 21 between two wagons. The carriages 131 of the same transport structure 13 are thus connected two by two by a connecting rod 134 comprising two opposite ends 134' that are spaced apart longitudinally, each of them 134' being preferably connected to one or the other of the two carriages 131 by a ball joint. Two articulations in series thus make it possible to ensure the connection between each carriage 131. During curved trajectories, the instantaneous center of rotation of the adjacent wagons is moved away as far as possible from the wagons, thus avoiding the risk of collision between two stacks of sleepers adjacent to the junction of two wagons.

Each carriage 131 defines a first support plane P1 of a stack of sleepers on which the stack rests when the carriages move said stacks of sleepers along the forward path W1. The displacement mechanism 130 further comprises a supporting structure 160 that defines a second support plane P2 of a stack of sleepers on which the stack of sleepers rests when the carriages move while being unloaded, i.e., without displacing stacks of sleepers in their movement, along the return path W2.

Figure 5:
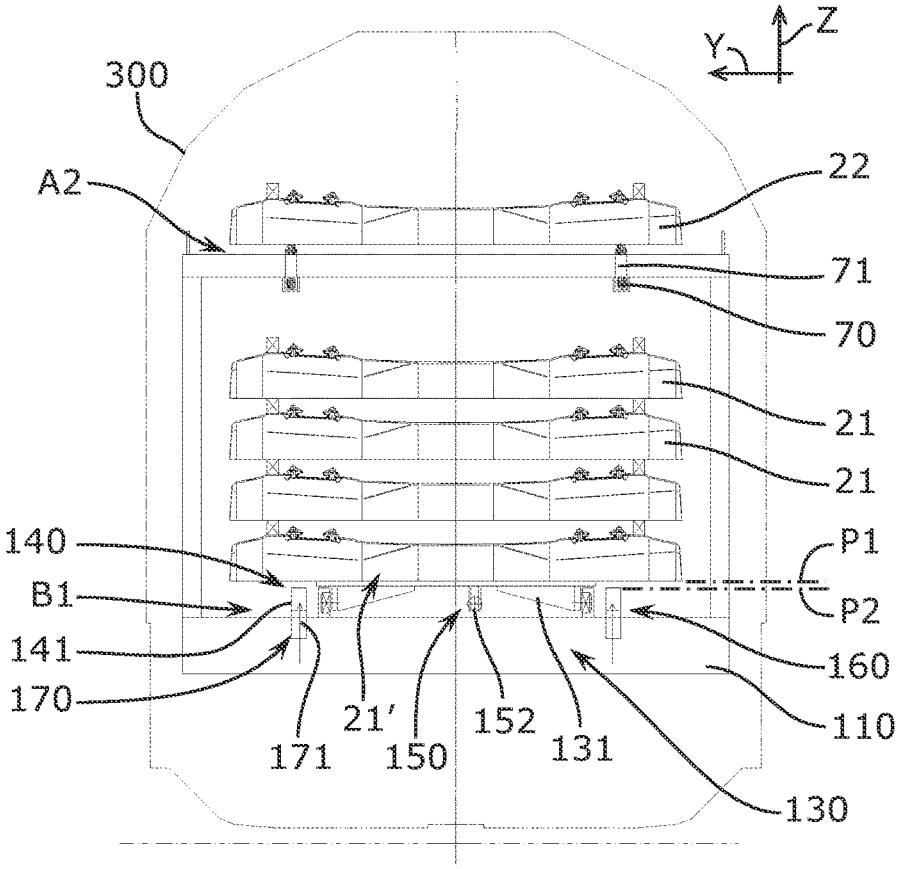
FIG. 5 is a simplified view in cross section of a work wagon forming a storage wagon according to one embodiment of the invention.

The displacement mechanism 130 comprises an elevator mechanism 170 that is configured to vary the relative vertical position of the first and second support planes P1, P2 relative to one another when the carriages 131 are in the first and second longitudinal travel position, so that each stack 21', 22' of sleepers 21, 22 rests on the vertically highest support plane among the first and second support planes P1, P2 (see FIG. 5). The supporting structure 160 is secured to the frame 110 of the work wagons by the lifting mechanism 170, which comprises jacks 171 such as double-acting hydraulic jacks. The supporting structure 160 has two support beams, each located on either side of the carriages 131 and each movable relative to the frame of the associated wagon to which it is linked by at least some jacks 171. The actuation of the jacks 171 thus makes it possible to vary the height of the supporting structure 160 relative to the chassis of the wagons and hence the height of the support plane P2. The supporting structure 160 has two support beams, each located on either side of the carriages 131. Each of these beams can be longitudinally continuous or discontinuous. In this embodiment, the beams are continuous longitudinally along each of the wagons, with discontinuities only between the wagons, so that each of these beams constitutes guide shoulders 141 that are located laterally on either side of each carriage 131 in order to laterally delimit the forward and return paths W1, W2. The transverse spacing between the two guide beams or shoulders 141 is configured to be less than the length of the sleepers. The width of the carriages 131 is therefore also less than the length of the sleepers, and also less than the distance separating the guide shoulders 141.

In this configuration:

The carriages 131, driven by the drive means 150, circulate on the guide track 132 guided by the guide means 140, and each transport a stack 21' of new sleepers 21 along the forward path W1 when the supporting structure 160 is in the vertically lowered position and is located under the support plane P1 of the carriages 131—i.e., when P2 is at a height lower than that of P1; and the carriages 131 circulate on the guide track 132 and are free to move along the return path W2 without manipulating the new sleepers 21 when the supporting structure 160 is in a position raised vertically at a level higher than that of the carriages 131—i.e., when P2 is at a height greater than P1.

A displacement sequence of the stacks of new sleepers 21 by the displacement mechanism 130 is as follows, for example:

in the first position of the longitudinal displacement of the carriages 131, the supporting structure 160 is lowered by the jacks 171 until the support plane P2 is located below the support plane P1, and the stacks of sleepers simultaneously come to rest on the support planes P1 of the carriages 131, each carriage 131 then supporting a stack 21' of new sleepers 21;

the drive means 150 move each carriage 131, each carrying a stack 21' of new sleepers 21 in a predetermined interval p corresponding to a spacing between two carriages 131, so as to arrive at a second position of longitudinal displacement of the carriages, corresponding for each to the first longitudinal position of the carriage that is located directly in front of it or downstream from it with respect to the direction of movement of the stacks of sleepers, meaning that, for a pair of adjacent carriages 131 among the plurality of carriages 131 comprising a front carriage and a rear carriage, the second travel position of the rear carriage corresponds to the first travel position of the front carriage;

when the carriages 131 are in the second longitudinal travel position, the supporting structure 160 is raised until the support plane P2 is located above the supporting plane P1, each of the stacks 21' being simultaneously lifted by the supporting structure 160 on the support plane P2 through the actuation of the jacks 171, the drive means 150 then move the empty or unloaded carriages 131 to their starting position, namely in the first longitudinal travel position of the carriages 131, in order to each position themselves under another stack 21' of sleepers 21, which has also just been moved during the sequence by the rear carriages.

Repeating the sequence in cycles allows the stacks 21' of new sleepers 21 to be moved step by step in the direction of the first zone Z1 for receiving and unstacking the new sleepers 21. Here, the drive means 150 comprise a chain 151 that engages with a drive wheel 152 integral with only one of the carriages 131 of the transport structure 13, preferably integral with the center carriage 131 among the three carriages 131 of a transport structure 13. The center carriage 131 is thus driven directly by the chain 151 of the drive means 150, and the front carriage 131A and the rear carriage 131C are themselves driven relative to this center carriage 131B indirectly by the center carriage 131 to which they are each linked by the connecting rod 134 (for example, see FIG. 9). It is possible to envisage a chain that circulates in a closed loop for each wagon, and/or one or more chains that circulate in a closed loop, some of which may be straddling two wagons. Such a chain makes it possible to drive each carriage 131 reciprocally in the direction of movement of the chain.

Figure 9:
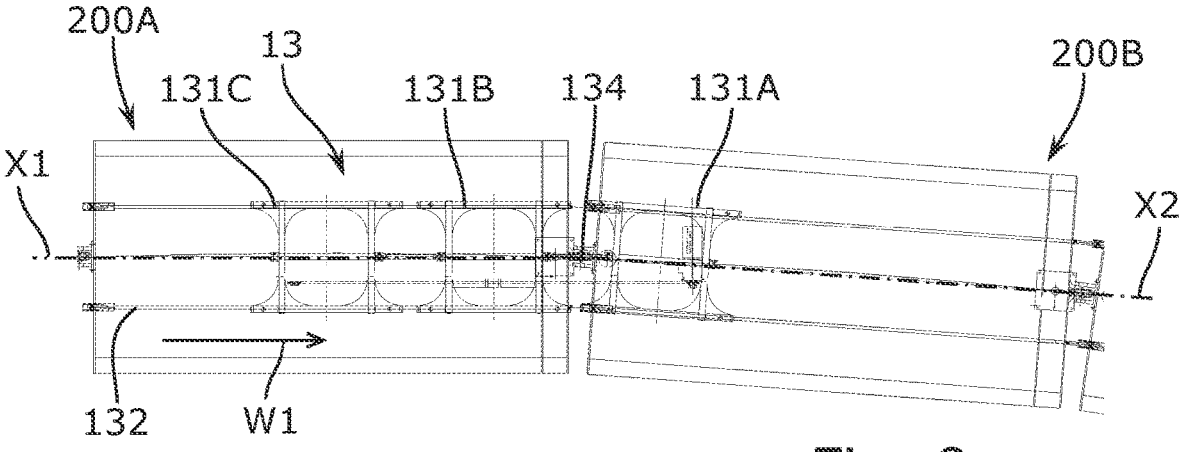
FIG. 9 is a plan view of two adjacent work wagons while the railway transport vehicle is on a curved path.

FIG. 9 is a detailed view of two wagons moving along a curved path of the railway track (not shown). Note that, in this embodiment, a wagon carries three stacks of sleepers that are aligned longitudinally, each transport structure 13 comprising here an equal number of carriages that the wagon can transport in a stack of sleepers along the forward path, i.e., three successive carriages 131. In the first longitudinal travel position of the carriages 131, a transport structure 13 composed of three carriages 131 is carried on the same wagon 200A. During the movement from the first to the second longitudinal movement position of the carriages 131, the foremost carriage 131A of the transport structure 13 continues its travel until it exits the wagon 200A, partially overhanging until it continues its guided course along a forward path of the adjacent wagon 200B downstream in the direction of movement of the stacks of sleepers, which is here the upstream wagon in the direction of movement of the train. In the second longitudinal travel position as shown in FIG. 9, the front carriage 131C is fully positioned on the wagon 200B, and the sleeper stack carried by this carriage can be removed. The center carriage 131B remains guided on the same wagon 200A, which is continuously driven by the drive means 150 without a discontinuity of entrainment between the two adjacent wagons. Furthermore, the connecting rod 134 articulated between the two carriages 131C and 131B makes it possible to take the curved trajectories of the train, implying that the longitudinal axis X1 of the wagon 200A is inclined relative to the longitudinal axis X2 of the adjacent wagon 200B. A transverse clearance can be provided between the carriages 131 and the guide shoulders 141 so as to facilitate the guiding of the carriages moving in straddling fashion between the two adjacent wagons 200A, 200B and interconnected along a curved path.

The transfer wagon 100 comprises a lifting mechanism 120 in the first zone Z1 for receiving and unstacking the new sleepers 21 toward which the stacks of sleepers moved by the displacement mechanism 130 converge one by one. This lifting mechanism 120 makes it possible, as a stack 21' of new sleepers 21 is unstacked, to raise the stack 21' by a predetermined height so that the new sleepers 21 located on an end-layer top of the stack are positioned at a predetermined height and can be more easily supported by the transfer conveyor 50 and improve the speed of movement of said transfer conveyor 50.

In this embodiment, there is only one transfer conveyor 50. The frame 60 that supports it comprises a plurality of uprights 62 standing vertically and carrying at least two horizontal beams 63 on which are arranged rails 61 for guiding and supporting a shuttle 53 that can be moved in translation longitudinally with respect to the frame 60. The uprights of the frame are secured relative to the frame 110 of the transfer wagon 100. The mobile shuttle 53 forms a horizontal structure moving on the two guide tracks formed by the rails 61, said shuttle 53 comprising at least one transverse beam, i.e., extending transversely between the two rails 61, and preferably two beams, forming an overhead crane that is guided by the guide and support rails 61.

The transfer conveyor 50 further comprises a system 51 for gripping at least one sleeper 21, 22 suspended by a lifting system 52 from the shuttle 53. The lifting system 52 is a cable lifting system. The gripping system 51 preferably comprises a lifting beam that is configured to transport a plurality of sleepers 21, 22 grouped together in a bundle. An operating mode will preferably be chosen in which the conveyor 50 moves the sleepers 21, 22 in bundles of a single layer, meaning that during their transfer, the sleepers 21, 22 are not superposed, but rather placed side by side.

The gripping system 51 comprises a spreader that is formed from one or more beams that are integral with one another and comprises jaws at its transverse ends facing one another, for example in the shape of an "L," each jaw being articulated by its end to the lifter and being controlled so as to pivot by a jack (not shown).

The work of the transfer conveyor 50, particularly of the shuttle 53, of the lifting system 52, and of the gripping system 51, is generally located inside a volume that is delimited by the frame 60 with the frame 110 of the transfer wagon 100. Moreover, whatever the working route of the transfer conveyor 50, it is contained for any position of its trajectory in a volume that is delimited laterally by a contour of the wagon 100 for transferring sleepers, preferably by a contour of its chassis 110, more preferably by the volume that is delimited by the frame 60. In this way, while ensuring the safety of people around the transfer wagon 100, the size of the wagon does not go beyond that of a conventional wagon.

The first conveying platform P1 and the first receiving zone Z1 are closer to a first end 101 of the transfer wagon 100 than the second conveying platform P2 and the second receiving zone Z2. In particular, the first conveying platform P1 and the first receiving zone Z1 are close to the front end 101 of the transfer wagon 100, whereas the second conveying platform P2 and the second receiving zone Z2 are closer to a second end 102 of the transfer wagon 100, i.e., the rear end.

Moreover, and although located at different heights, the first conveying platform P1 is closer to the first end 101 of the transfer wagon 100 than the first receiving zone Z1. Similarly, the second conveying platform P2 is closer to the second end 102 of the transfer wagon 100 than the second receiving zone Z2. These longitudinal offsets allow accessibility by the transfer conveyor 50 along the same axis, corresponding to its axis of translation along the frame 60.

The first conveying platform P1 is situated at a height greater than that of the first receiving zone Z1, and the second conveying platform P2 is situated at a height greater than that of the second receiving zone Z2. By positioning the first conveying platform P1 at a height greater than that of the first receiving zone Z1, and in relation to the storage wagons 300, the second removal conveyor device A2 is placed above the first forwarding conveyor device B1. The sleepers are stored in the form of stacks of sleepers and are placed under the second removing conveyor device A2, which in turn transports the sleepers in bundles of a single layer of sleepers, i.e., without superposition of sleepers. This makes it possible to place the center of gravity as low as possible and thus to ensure better stability for the different wagons, such as the transfer wagon 100 and the storage wagons 300.

Due to the arrangement of the first conveying platform P1 with respect to the first receiving zone Z1 and of the second conveying platform P2 with respect to the second receiving zone Z2, these removal and supply flows C1 C2 are crossed here. Since the transfer conveyor 50 is the only one to operate the two flows, namely the removal flow C1 for worn sleepers 22 and the supply flow C2 for new sleepers 21, the transfer steps are implemented in a sequenced manner.

Along a longitudinal axis X, the first and second platforms P1, P2 and the first and second zones Z1, Z2 are situated such that the transfer conveyor 50 is able to travel the paths of the removal and supply flows C1, C2 when it translates longitudinally with respect to the frame 60 in a single round trip between two extreme longitudinal positions. In this first embodiment, the transfer wagon 100 comprises, in a longitudinal direction X from the rear to the front: the first conveying platform P1, the first receiving zone Z1, the second receiving zone Z2, and then the second P2 conveying platform.

Figure 4:
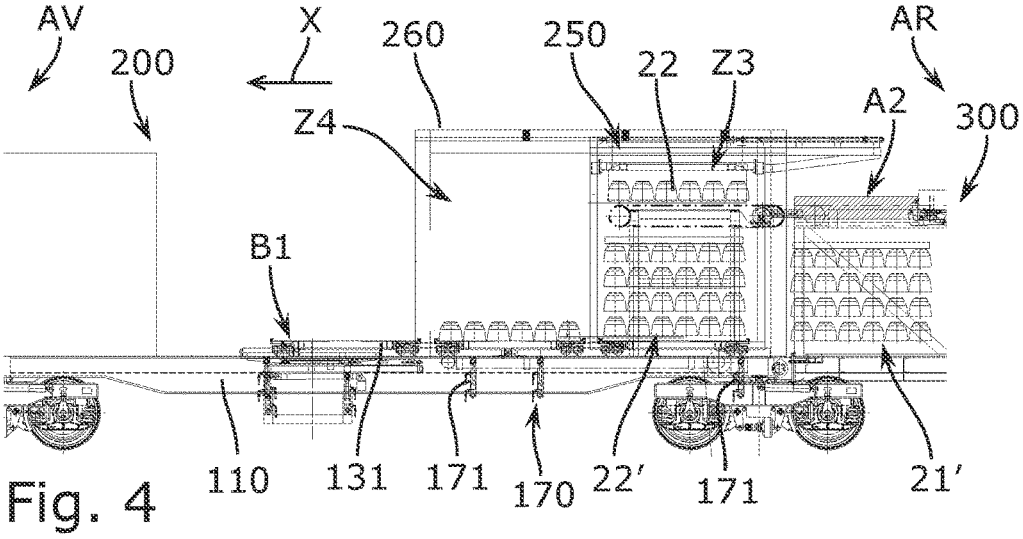
FIG. 4 is a side view of a stacking wagon for worn sleepers according to this embodiment of the invention.

The railway vehicle 1 also comprises a stacking wagon 200 for worn sleepers 22, which is illustrated in FIG. 4. This stacking wagon 200 is located directly after the storage wagons 300, themselves located directly after the transfer wagon 100 in the direction from the rear AR to the front AV of the railway vehicle 1. The stacking wagon 200 comprises a stacking transfer conveyor 250 that transfers the worn sleepers 22 from a third zone Z3 for receiving the worn sleepers 22 coming from the transfer wagon 100 after having been conveyed by the second removing conveyor device A2 until having been placed on a stack 22' of worn sleepers 22 to be stacked. This stacking zone Z4 is located on the supporting structure above the guide track 132 of the carriages 131. In this way, once the stack 22' of worn sleepers 22 has been completed by the transfer conveyor 260, it can be advanced by the displacement mechanism 130 by a certain predetermined interval p, corresponding to the interval p of the displacement of the stack of new sleepers 21' toward the first receiving zone Z1. These operations are concomitant, given that the railway vehicle 1 lays as many new sleepers 21 as it removes worn sleepers 22. In this way, when a stack of new sleepers 21 is emptied at the front of the storage area in the first receiving zone Z1, a stack 22' of worn sleepers 22 is completed at the rear of the storage area in the stacking zone Z4. The stacking zone Z4 and the first receiving zone Z1 form the two longitudinal ends of the first forwarding conveyor device B1.

The third receiving zone Z3 comprises, or even consists of, one of the ends of the second removing conveyor device A2 opposite the end constituting the first conveying platform P1. A buffer zone (not shown) can also be provided to receive the sleepers.

The single stacking conveyor 250 is supported by an associated frame 260, said frame 260 being supported by the frame and secured relative to said frame. This stacking transfer conveyor 250 may be of a similar design to that of the transfer conveyor 50, but it may be of a smaller size, since the distance to be traveled is shorter.

The stacking wagon 200 further comprises a turntable system (not shown) that makes it possible to pivot at least one stack of sleepers, for example by 90°, in order to facilitate handling thereof by a handling means external to the machine.

Figure 6:
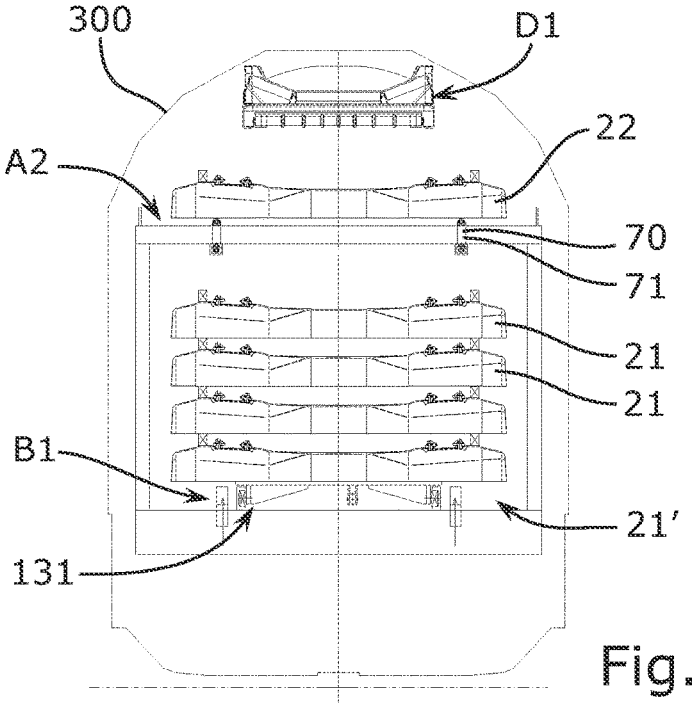
FIG. 6 is a simplified view in cross section of a work wagon forming a storage wagon according to one embodiment of the invention.
Figure 7:
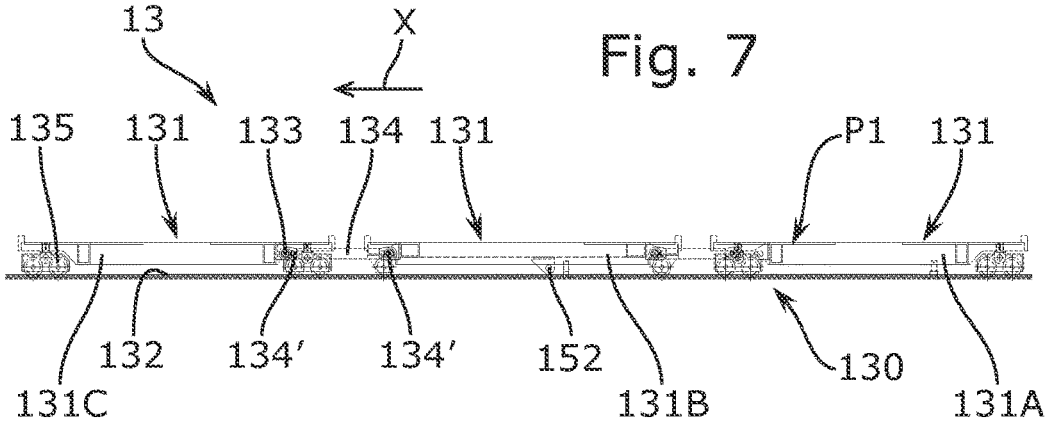
FIG. 7 is a side view of a transport structure according to one embodiment of the invention comprising three carriages that are mutually articulated.
Figure 8:
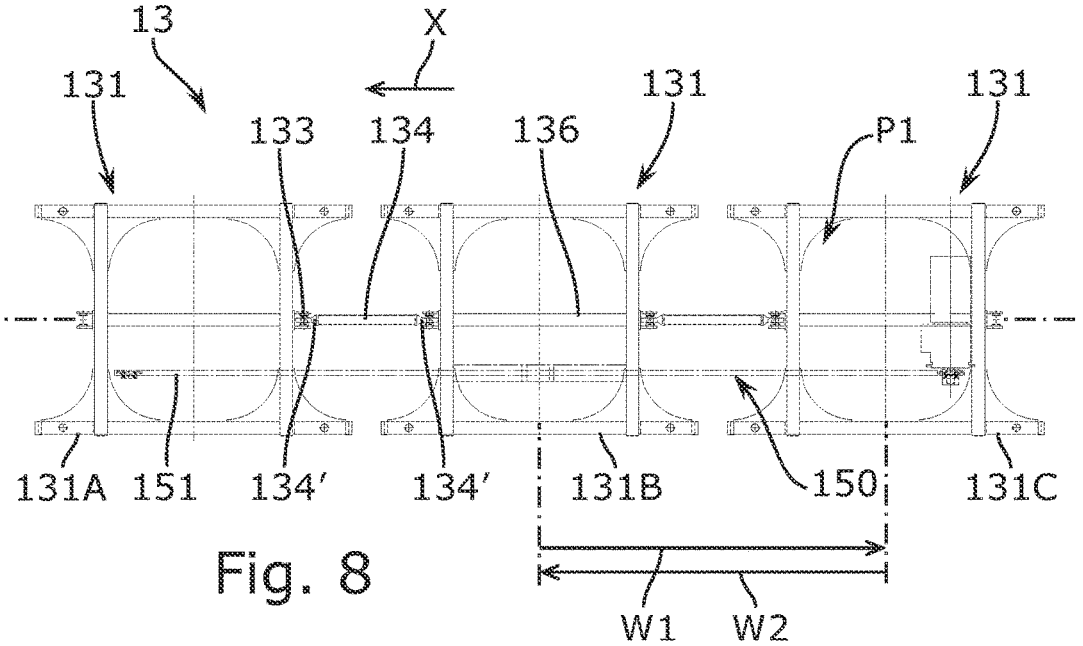
FIG. 8 is a plan view of FIG. 7.

FIG. 6 shows a sectional view of a storage wagon 300 that differs essentially from that of FIG. 5 in that the renewal train comprises a third conveyor device D1 that is configured to transport material such as ballast. As will be readily understood, it can be used ballast, new ballast, or even treated ballast from used ballast after having undergone a treatment that enables it to be recycled.

In particular, this sectional view shows the positioning of the third conveyor device D1, which is located vertically above the first removing conveyor device B1 and hence above the displacement mechanism 130 and the second removing conveyor device A2. Here, the illustrated wagon is located upstream from the transfer wagon 100 with respect to the direction of travel of the train. On a portion located downstream from the transfer wagon 100 with respect to the forward direction of the train, the third conveyor device D1 will be positioned in this case such that it is located vertically above the second forwarding conveyor device B2 and the first removing conveyor device A1. In this case, in order to ensure the continuity of the conveyance on the third conveyor device D1, said third conveyor device D1 will be placed vertically above the conveyor 50 at the level of the transfer wagon 100.

In general, it should be noted that, regardless of the flow of sleepers implemented by the railway vehicle, the transfer wagon preferably comprises a third conveyor device, for example for conveying material such as ballast, that is located vertically above the transfer conveyor.

Figure 10:
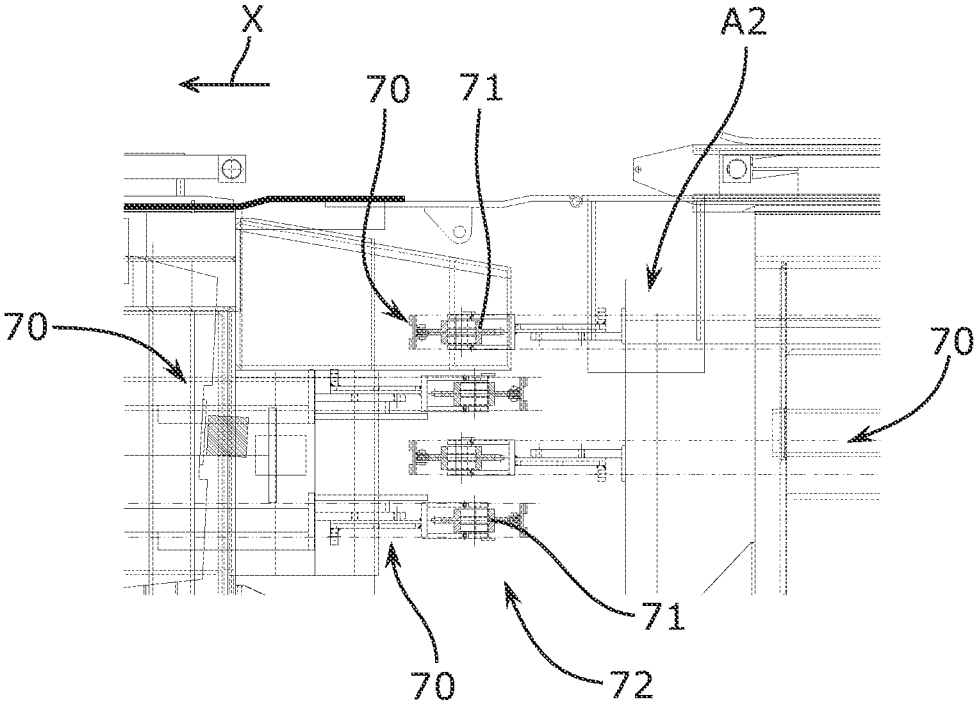
FIG. 10 is a plan view of a junction between two conveyors.

FIG. 10 shows an intersection 72 or overlap on the same horizontal plane of two pairs of chains 70 of a chain conveyor device 70. Such an interweaving of two pairs of chains, each continuous and circulating in a closed loop and arranged successively along the drive path, makes it possible to ensure a continuity of movement in the conveyance of the sleepers 21, 22. Furthermore, this intersection of the end portions of the two pairs of chains 70 is made so as to have a predetermined spacing that is sufficient to allow minimum articulation between the two conveying portions, each of which is formed by a pair of chains. Such a configuration is particularly advantageously at the intersection between two wagons and makes it possible to ensure perfect conveyance of the sleepers 21, 22 without being impacted by the curves of the railway on which the train 1 is traveling.

As will be readily understood, the invention was described in the foregoing as an example. It is understood that a person skilled in the art is in a position to produce various variant embodiments of the invention without, however, departing from the scope of the invention.

It is possible, for example, to consider a substantially different configuration of the transfer wagon. For example, it is possible to place the second receiving zone Z2 at a height greater than that of the second conveying platform P2 and/or to place the second receiving zone Z2 closer to a second end 102 of the transfer wagon 100 than the second conveying platform P2, so that the transfer wagon 100 comprises, in a longitudinal direction from rear to front: the first conveying platform P1, the first receiving zone Z1, the second conveying platform P2, and then the second receiving zone Z2.

As will be readily understood, the use of a displacement mechanism 130 as described is not limited to the strict use of the displacement of the stacks 21' of new sleepers 21 to form the first removing conveyor device B. For example, whether in a complementary manner or not, the first removing conveyor device A1 can be constituted by, or comprise, a displacement mechanism 130 having all or some of the aforementioned features.

It is also conceivable for the supporting structure to be secured and for the lifting mechanism to act on the carriages. It is possible to envisage an embodiment in which the carriages move on a closed loop path, conferring to each of them individually a change in vertical position or not. It is also conceivable for a lifting mechanism to be housed in whole or in part in a thickness of each of the carriages and for them to be configured so as to vary the height of the support planes P1.

It is emphasized that all of the features, as they become apparent to a person skilled in the art from the present description, the drawings, and the appended claims, even if they have been concretely described only in relation to certain other features, both individually and in any combination, may be combined with other features or groups of features disclosed herein, provided that this has not been expressly excluded or technical circumstances make such combinations impossible or nonsensical.

The invention claimed is:

1. A mechanism for moving stacks of sleepers intended to equip a railway track, the displacement mechanism being intended to equip a group of at least two successive work wagons of a railway vehicle, each work wagon comprising a frame supported by at least one wheelset, the displacement mechanism comprising guide means configured to guide, along a longitudinal direction of each of the work wagons, a plurality of adjacent carriages in pairs and each defining a first support plane, the displacement mechanism comprising drive means for moving the carriages together back and forth along a same path between a first and a second travel position, and a supporting structure defining a second support plane, the displacement mechanism comprising an elevator mechanism that is configured to vary the relative vertical position of the first and second support planes relative to one another between at least:

a vertically lowered position, when the second support plane is at a lower height than the first support plane, and a vertically raised position, when the second support plane is at a height greater than that of the first support plane, in the first and second travel positions of the carriages, so that each of the stacks of sleepers can rest on the vertically highest support plane among the first and second support planes, the said displacement mechanism being configured so that in the vertically lowered position, the displacement mechanism is such that each carriage is able to carry one of the stacks of sleepers on the first support plane following a forward path from the first to the second travel position, such that for a given pair of adjacent carriages among the plurality of carriages comprising a front carriage and a rear carriage, the second travel position of the rear carriage corresponds to the first travel position of the front carriage and is configured so that:

in the vertically raised position, the displacement mechanism is such that each carriage is able to travel a return path from the second to the first travel position while being unloaded without displacing the stacks of sleepers in their movement, along the return path, each of the stacks of sleepers being able to be supported on the second support plane when the carriages move along the return path.

2. The displacement mechanism according to claim 1, wherein at least some of the pairs of adjacent carriages are interconnected by at least one articulation to form a transport structure, so that each transport structure comprises three successive carriages.

3. The displacement mechanism according to claim 2, wherein the carriages of the same transport structure are connected in pairs by a connecting rod, the connecting rod comprising two opposite ends spaced apart longitudinally, each of which is connected to one or the other of the two carriages by a ball joint.

4. The displacement mechanism according to claim 3, wherein it is configured to move each carriage back and forth by an interval corresponding to a distance between the first travel position and the second travel position, which is greater than or equal to a length of a stack of sleepers.

5. The displacement mechanism according to claim 3, wherein the guide means comprise guide shoulders that are located laterally on either side of each carriage in order to provide lateral delimitation of the forward and return paths.

6. The displacement mechanism according to claim 2, wherein it is configured to move each carriage back and forth by an interval corresponding to a distance between the first travel position and the second travel position, which is greater than or equal to a length of a stack of sleepers.

7. The displacement mechanism according to claim 2, wherein the guide means comprise guide shoulders that are located laterally on either side of each carriage in order to provide lateral delimitation of the forward and return paths.

8. The displacement mechanism according to claim 1, wherein it is configured to move each carriage back and forth by an interval corresponding to a distance between the first travel position and the second travel position, which is greater than or equal to a length of a stack of sleepers.

9. The displacement mechanism according to claim 8, wherein the guide means comprise guide shoulders that are located laterally on either side of each carriage in order to provide lateral delimitation of the forward and return paths.

10. The displacement mechanism according to claim 1, wherein the guide means comprise guide shoulders that are located laterally on either side of each carriage in order to provide lateral delimitation of the forward and return paths.

11. The displacement mechanism according to claim 10, wherein the supporting structure forms the guide shoulders.

12. The displacement mechanism according to claim 10, wherein the supporting structure is secured to the frame by the lifting mechanism, said lifting mechanism comprising jacks.

13. The displacement mechanism according to claim 1, wherein the drive means comprise at least one chain that engages with a drive wheel that is integral with all or some of the carriages in order to drive each carriage back and forth, the chain driving a carriage directly by transport structure.

14. A railway work vehicle of the type comprising equipment for laying new sleepers and/or removing worn sleepers, the railway vehicle comprising at least two successive work wagons, wherein the railway work vehicle comprises at least one mechanism for moving stacks of sleepers according to claim 1.

15. The railway work vehicle according to claim 14, wherein at least some of the work wagons further comprise an upper conveyor device that is located at a height greater than that of the displacement mechanism, the conveyor device being configured to transport the sleepers individually.

16. The railway work vehicle according to claim 15, wherein the displacement mechanism enables sleepers to be moved in stacks of superposed sleepers, in a first direction of displacement along a longitudinal direction of each given work wagon, and in that the upper conveyor device allows the displacement of sleepers individually, in a second direction of movement opposite the first direction along the longitudinal direction of each given work wagon.

* * * * *